United States Patent [19]

King, Jr.

[11] 4,184,494

[45] Jan. 22, 1980

[54] FEMININE PERFORMANCE COSTUME GARMENT

[75] Inventor: Leroy A. King, Jr., York, Pa.

[73] Assignee: Tighe Industries, East Prospect, Pa.

[21] Appl. No.: 944,912

[22] Filed: Sep. 22, 1978

[51] Int. Cl.[2] ..... A41C 1/00

[52] U.S. Cl. ..... 128/519; 2/67; 2/406

[58] Field of Search ..... 128/519; 2/78, 72, 67, 2/71, 238, 272, 110, 109, 107, 406, 407

[56] References Cited

U.S. PATENT DOCUMENTS

| | | | |
|---|---|---|---|
| 1,701,933 | 2/1929 | Rivkin | 2/67 |
| 1,781,271 | 11/1930 | Cowdrey | 2/67 |
| 2,033,456 | 3/1936 | Cunningham | 2/67 |
| 2,799,023 | 7/1957 | Goodman | 2/78 |
| 3,771,172 | 11/1973 | Barg | 2/67 |

*Primary Examiner*—Doris L. Troutman

*Attorney, Agent, or Firm*—Samuel M. Learned, Jr.

[57] ABSTRACT

A feminine performance costume garment for wearer use primarily in dance or competitive athletic activities such as gymnastic events and the like, and method of making the same, structurally comprising in combination an exterior costume garment and a panty brief undergarment wherein the undergarment is affixed integrally to the exterior costume garment by sewably stitched communication at the respective garment leg openings and vertically by stitching along the laterally disposed respective sides thereof, in such a manner so that during practice and performance use by one attired in such a performance costume garment combination the undergarment and exterior costume garment leg openings, by virtue of the combined structural construction of being respectively secured one to the other so as to move together as a unit, thereby eliminates the problem otherwise encountered by the exterior costume garment leg openings riding up to expose the undergarment in the crotch area and upper thigh leg areas of the wearer during performance use.

25 Claims, 8 Drawing Figures

FEMININE PERFORMANCE COSTUME GARMENT

BACKGROUND OF THE INVENTION

It is to be understood that the instant invention relates to feminine performance costume garments of those types characteristically worn by girls and women performer participants in activities such as dance of either the ballet or modern school disciplines, competitive athletic activities such as gymnastic and either ice or roller skating events which would also include the athletic activities of tennis and swimming and diving events and the like, as well as costume attire for specialized uses such as would traditionally be worn by feminine circus performers in equestrian and tightrope performance acts and the like, all of which attire is in one form or another basically a leotard, herein referred to more broadly, however, to be inclusive of the foregoing but not necessarily per se limited thereby, as being feminine performance costume garments.

Heretofore, performance costume garments, such as gymnastic and dance or theatrical leotards, ice and roller skating costumes, swimming suits and the like for instance, for feminine attire, have been comprised generally of the following two structural types.

First, the traditional style of gymnastic or dance leotard, or bathing suit attire, having distinctly separate under and outer garments as characterized by the respective disclosures taught in U.S. Pat. No. 2,799,023 to Goodman dated July 16, 1957, U.S. Pat. No. 3,023,419 to Strahle dated Mar. 6, 1962, and U.S. Pat. No. 3,771,172 to Barg dated Nov. 13, 1973; wherein the Strahle disclosure is of particular interest in that it teaches a conventional leotard garment style, modified, however, by an invisible flap opening in the crotch area thereof whereby is facilitated the removal for changing of wearer undergarment attire without the necessity of having to completely remove the leotard.

Secondly, gymnastic and bathing attire of structurally modified design to embody as an integral construction feature the combined incorporation of a trunk or panty brief undergarment sewn about the waist band thereof to the outer costume garment as is disclosed in the respective teachings of U.S. Pat. No. 1,701,933 to Rivkin dated Feb. 12, 1929, and U.S. Pat. No. 1,781,271 to Cowdrey dated Nov. 11, 1930.

Certain additional features are also shown in the prior art, such as exemplified by the bathing suit disclosure set forth in U.S. Pat. No. 2,033,456 to Cunningham dated Mar. 10, 1036, further teaching therein the embodiment of a crotch insert as an integral element of the undergarment structure.

As is the case with both of the foregoing general types of feminine costume garment structures, whether of the separate and distinct under and outer garment type as first recited, or the combined under and outer garment type as secondly recited, neither type provides for appropriate means to prevent the outer costume garment leg openings from riding up the thighs of the wearer while executing routine movements during attired use in activity and presentation or competitive performance events, with the consequent result that any undergarment panty brief attire worn by the feminine attiree is subjected to being exposed to spectators, all of which detracts from the presentation, reduces performer concentration and poise, and in competitive dance or gymnastic and athletic events usually results in a lower rating by judging officials than would otherwise be obtainable but for the inherent and apparent distraction and concern factors obviously demonstrated by a feminine performer in modesty about panty undergarment exposure in the crotch and upper thigh areas during her performance presentation.

The instant invention overcomes the problem of panty brief exposure in the crotch and upper thigh areas of the wearer of a feminine performance costume garment during performance use while attired therein, and although some of the elements of the present invention have been disclosed in the art there is no description therein of that combination of elements resulting in the present structures and resultant construction features of novel merit as set forth hereinafter.

SUMMARY OF THE INVENTION

It is the principal object of the present invention to provide a feminine performance costume garment for wearer use primarily in either dance or competitive athletic activities such as gymnastic and skating events and the like, wherein the exterior costume garment portion thereof is provided with a self-contained panty brief undergarment incorporated therewith in structurally integral combination thereto whereby the resultant construction accomplished through sewing the respective leg openings of the panty brief undergarment slightly interior of the respective corresponding leg openings of the exterior costume garment by stitched communication thereto plus an additional body-lateral opposingly disposed vertical side-stitching of the undergarment panty brief to the exterior costume garment thereby enables the leg openings of the respective garments in combination to move together as a unit, the use of which performance costume garment of the instant invention eliminates wearer nusiance and concentration distraction from presentation routine otherwise in evidence when costumed in conventional garment attire during dance or competitive athletic performances as manifested by the wearer's continual attempts to hitch down the exterior costume leg openings which are detached from the panty brief undergarment leg openings, the same being currently conventional of such costume attire, as the exterior costume leg openings characteristically ride up the wearer/performer's thighs during body movement activities to thereby expose the panty brief undergarment in the crotch and upper thigh areas, all of which consequently reduces overall wearer/performer poise and appearance as well as performance rating when engaged in competitive athletic events.

It is another object of the present invention to provide a feminine performance costume garment that in turn provides optimum wearer comfort and confidence.

It is a further object of the present invention to provide a feminine performance costume garment construction method which may be utilized in conjunction with any one of a wide variety of exterior costume garment styles characteristic to various athletic activities, including but not necessarily limited to gymnastic, ice and roller skating, ballet and modern dance, tennis, bathing and play suit attire as well as circus performer costume attire, all being inclusive but not all inclusive since the same are exemplary only.

till another object of the present invention is to provide a feminine performance costume garment having a panty brief undergarment which embodies a pliable crotch area insert member to lend crotch area structural support to said garment and prevent crotch area binding discomfort to the wearer thereof.

It is yet another object of the present invention to provide a feminine performance costume garment having a panty brief undergarment constructed in such a manner as to enable the shaping thereof in a form-fitting conformation to the buttocks of the wearer.

It is also an object of the present invention to provide an improved feminine performance costume garment and method for making the same which is inherently simple and readily adaptable to efficient and low cost mass production manufacturing techniques.

DETAILED DESCRIPTION OF THE INVENTION

Figure 1:
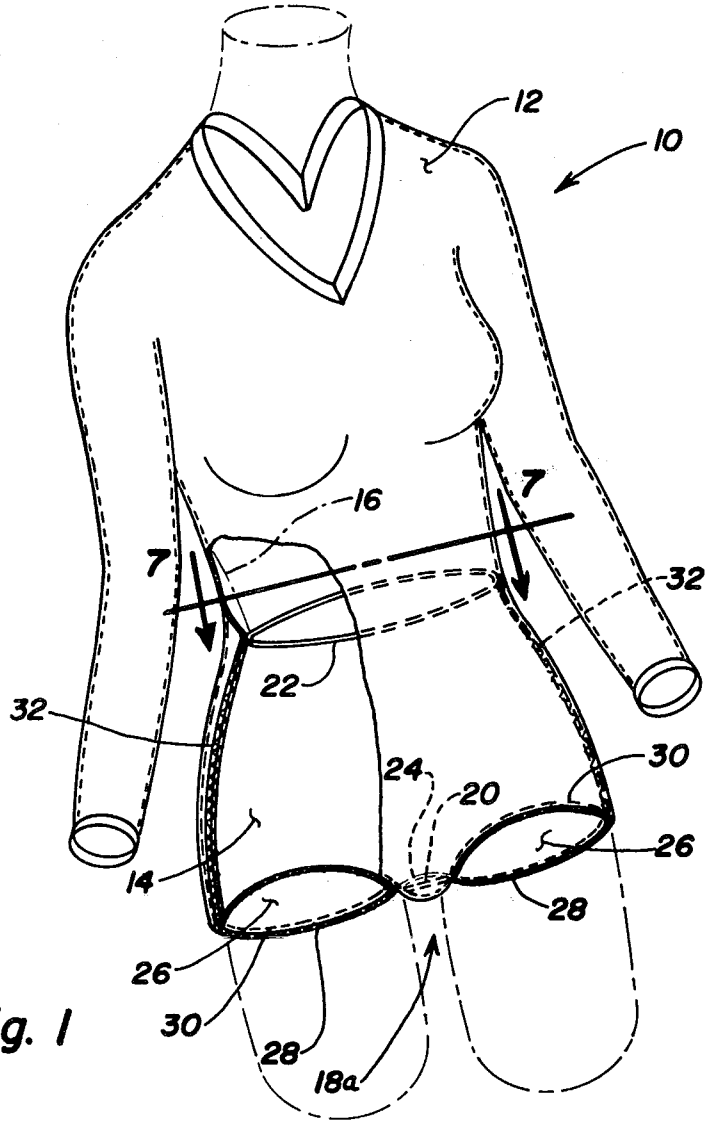
FIG. 1 is a perspective view of an exemplary style of a feminine performance costume garment illustrating therein a conventional panty brief undergarment in combination therewith as embodies the principles taught by the present invention, showing also in phantom a torso rendition of a typical wearer thereof.

Referring to FIG. 1, the feminine performance costume garment invention is shown in the modified conventional panty brief undergarment combination version 10 thereof, which comprises an exemplary exterior feminine performance costume garment 12 of the style illustrated, which in the present instance is of the long-sleeved and short-legged variety with a V-neck, and a modified conventional panty brief undergarment 14 in integral stitched combination with said exemplary exterior feminine performance costume garment 12 as the modified conventional panty brief undergarment combination version 10 would characteristically appear in attired use upon the torso body portion of an exemplary feminine wearer 16 thereof.

Prior to proceeding into a detailed description of the invention it should be noted, as will hereinafter more fully be explained with reference to subsequently described FIGS. 2 through 8 illustrated in the accompanying drawings, that the exterior feminine performance costume garment per se may embody any one of a wide variety of styles characteristic to the athletic, dance, and performance activities heretofore enumerated, but is generally a leotard type attire garment of either a woven fabric material which may or may not be styled as form-fitting, or a knit fabric material which is generally styled to be form-fitting, either of which type attire garment may be further styled as to neck type, sleeve length, the incorporation of a skirt of either straight or pleated design, and the like, which may be embodied in various alternative style rendition combinations wherein the above-recited possibilities and the subsequently described Figures in illustration thereof are to be regarded as exemplary only and not limiting of the exterior feminine performance costume garment styles of current popularity or those of a leotard type attire garment which may become stylishly popular at some future time.

As further regards the description hereinbefore of the instant invention, it is to be understood that that anatomical portion of a female described about the upper thigh leg areas, including the same as well as the crotch area of such a person, is herein defined, and hereinafter referred to, as the crotch area.

The modified conventional panty brief undergarment 14 is, as the nomenclature identification thereof indicates, a conventional knit panty brief of that variety having generally stretch and form-fitting characteristics as is well known in the art, but, however, of modified construction in the crotch area as will hereinafter be fully described.

Referring again to FIG. 1 to describe in greater detail the component parts of this invention as well as explain the structurally cooperative features thereof, in addition to the method for making the same. First, the modified conventional panty brief undergarment 14 is fabricated in knit material construction by standard methods as are well known in the art, however, upon completion of such fabrication the crotch area material portion 18a thereof is modified to embody the incorporation of a pliable crotch area insert 20 which is a synthetic or natural or combination fabric material of a greater thickness than that material from which said panty brief undergarment 14 is made and being generally of an elongated rectangular shape configured as shown, but more suitably illustrated as such in FIGS. 2 and 7, wherein said pliable crotch area insert 20 provides structural and shaping support to the panty brief undergarment crotch area material portion 18*a* and, by virtue of the additional construction features herein, primarily wherein the panty brief undergarment waist band 22 is not peripherally affixed to the exterior feminine performance costume garment 12, thereby prevents crotch area binding to the wearer thereof during attired use therein.

The pliable crotch area insert 20 may be directly sewn in place, or adhered in the crotch area position by suitable adhesive means interposed between the respective material contact surfaces, but preferably as shown is retained by means of a rectangular shape crotch area insert overply 24 of a suitably soft and absorbent fabric material such as cotton or the like, of a slightly larger rectangular shape dimension than said insert 20, and is sewn to the crotch area material portion about the peripheral edges thereof by overply stitching 21 to thereby retain the same in structural and shaping supportive position within the panty brief undergarment crotch area material portion 18*a* thus modified.

It is to be noted, that although the crotch area insert overply 24 provides the traditional security and comfort features to a feminine wearer of a panty brief undergarment, the primary purpose thereof in the instant invention is to not only provide the foregoing feature but also to serve as that means whereby the pliable crotch area insert 20 is retained in proper supportive and shaping position.

Upon completion of fabrication of the modified conventional panty brief undergarment 14 as heretofore described, which may be accomplished by high-speed automated sewing methods as are well known in the art, said modified conventional panty brief undergarment 14 is then ready for stitched integral combined communication with an exemplary exterior feminine performance costume garment such as 12. At some other location, and on some other fabrication line, the exemplary exterior feminine performance costume garment 12 will have been completed, excepting, however, for the tucking and hemming of the respective leg openings 26 thereof, also by high-speed automated sewing methods as are likewise well known in the art, wherein the combination of said garments 12 and 14, and the method of combination thereof, provide the new and novel features taught by the instant disclosure.

Figure 2:
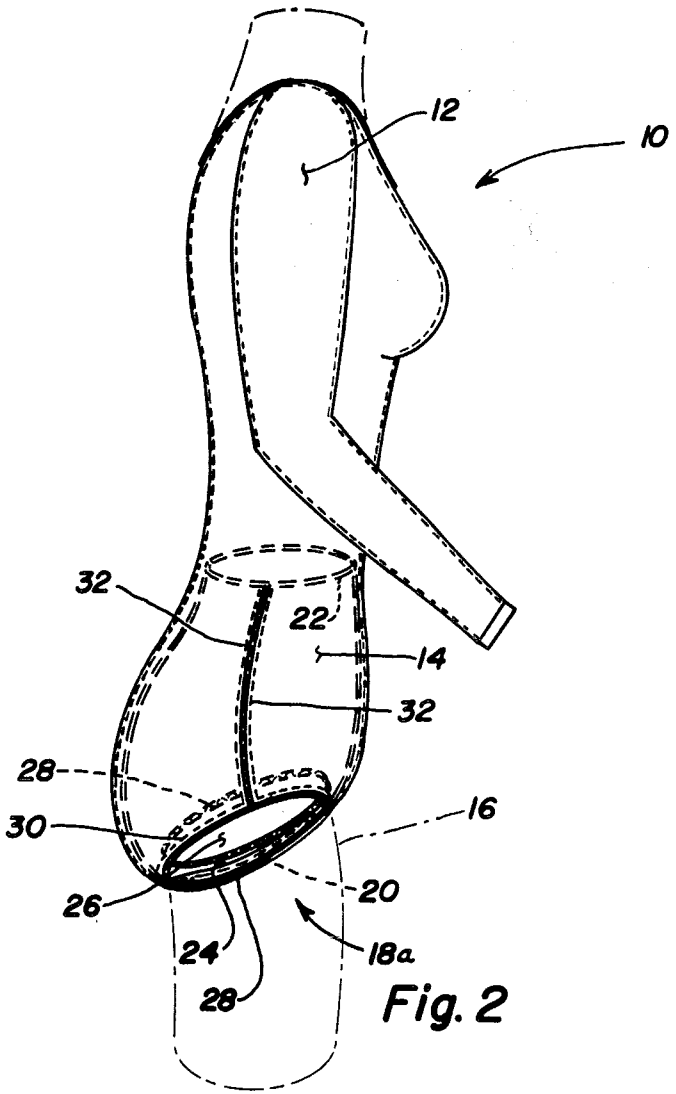
FIG. 2 is a side elevation of the exemplary style of the feminine performance costume garment and conventional panty brief undergarment combination as shown in FIG. 1.

The combination of garments 12 and 14, one to the other, is accomplished in a two-step sewing operation as follows. First, a modified conventional panty brief undergarment of a size appropriate to that of the exterior garment with which it is to be combined is selected, and inserted and positioned within the exemplary exterior performance costume garment 12 as shown in FIGS. 1 and 2, with the respective garment fronts to the front and backs to the back in relation to the body of an exemplary feminine wearer thereof, whereupon the unfinished exterior leg openings are respectively tucked peripherally about the respective undergarment leg opening hems to form a combined finished leg opening hem 28 respectively secured by leg opening stitching 30. Second, the body lateral opposite sides of the respective garments 12 and 14 are secured one to the other by parallel vertical stitching 32 therealong, extending vertically upward from an extreme lateral tangent to the respective combined finished leg opening hems 28 respectively to opposite extreme lateral tangents to the panty brief undergarment waist band 22.

By virtue of the foregoing feminine performance costume garment 10 construction, wherein the respective leg openings of the exterior and under garments through the combined finished leg opening hems 28 move together as a unit during attired use of said costume garment 10 upon a wearer thereof and thereby prevent exposure of the panty brief undergarment 14 in the crotch and upper thigh areas of the wearer, while at the same time obviating crotch area binding to the wearer as a result of the structural support provided by the pliable crotch area insert 20 in combination with the relatively free panty brief waist band 22 feature wherein said waist band is secured to the exterior costume garment 12 only at and along opposite vertical segments tangent respectively to the extreme body lateral hip portions thereof, all as illustrated in FIG. 1.

Preferably, the feminine performance costume garment of the present invention is made from any suitable natural, synthetic, or combination fabric materials, either woven or knit, but, however, conformed in styling thereof to be basically form-fitting to the body contact portions of the wearer thereof.

Referring now to FIG. 2, which is a side elevation of the feminine performance costume garment shown in FIG. 1, illustrating more specifically the structural configuration relationship of component elements of said costume garment comprised of the respective garment 12 and 14 combination as heretofore described. Additionally shown in FIG. 2 in detail more illustrative of the foregoing descriptions are the pliable crotch area insert 20 in crotch area structural configuration to the rectangular shape crotch area insert overply 24 by which said pliable crotch area insert 20 is preferably retained in position within the modified conventional panty brief undergarment crotch area material portion 18*a* whereby structural shaping and support is provided thereto and crotch area binding to the attired feminine wearer thereof is prevented during athletic activity or performance use therein. Also more clearly illustrated in FIG. 2 is the leg opening stitching 30 as well as the vertical stitching 32 whereby the respective features of unitary movement of the exterior costume garment 12 and panty brief undergarment 14 leg openings resultant from the combined finished leg opening hem 28 construction, and the relatively free panty brief waist band 22 construction assembly to the exterior costume garment 12 only at and along the vertical segments tangent respectively to the extreme body lateral hip portions thereof and being cooperative with the pliable crotch area insert 20 whereby crotch area binding to an attired wearer of said feminine performance costume garment 10 is prevented, are shown.

It is at this point to be noted that the exemplary exterior feminine performance costume garment 12, as respectively shown in FIGS. 1 and 2, is illustrative of that exterior stylistic costume version of the instant invention 10 which would be characteristically worn by feminine performers in competitive gymnastic events, and is therefore to be regarded herein as a feminine performance costume garment attire for competitive gymnastic events.

Figure 3:
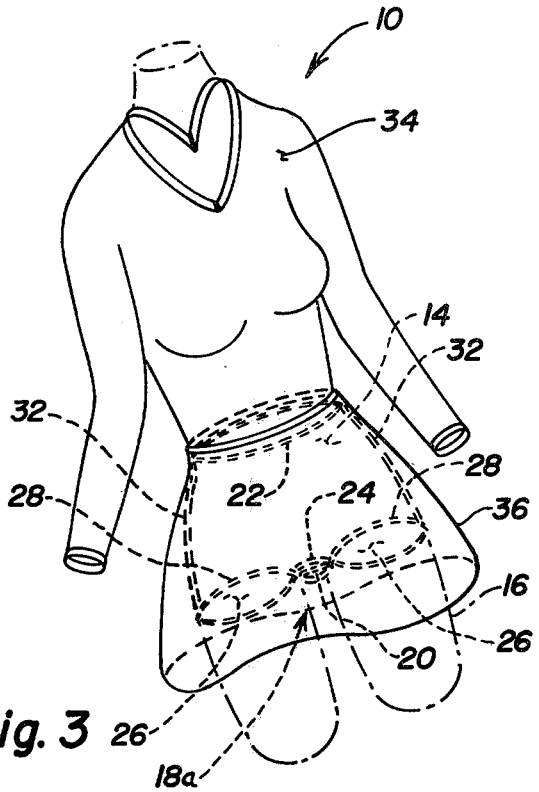
FIG. 3 is a reduced scale perspective view, similar to that as shown in FIG. 1, of another exemplary style of a feminine performance costume garment and conventional panty brief undergarment combination embodying the principles of the present invention.

In FIG. 3 the feminine performance costume garment invention 10 hereof, in the modified conventional panty brief undergarment combination version thereof, is shown however with an exemplary exterior feminine performance costume garment 34 provided with a plain skirt 36 assembled thereto as shown, being illustrative of that exterior stylistic costume version of the instant invention 10 which would be characteristically worn by feminine participants and/or performers in skating events, which it is to be understood is inclusive of both ice and roller skating activities. All other structural and wearer advantage features of the respective garment 34 and 14 combination as heretofore described in detail for the respective garment 12 and 14 combination remain the same, the only change being in that of the exterior costume portion stylistic modification for use application in other athletic activity events such as ice and roller skating.

Figure 4:
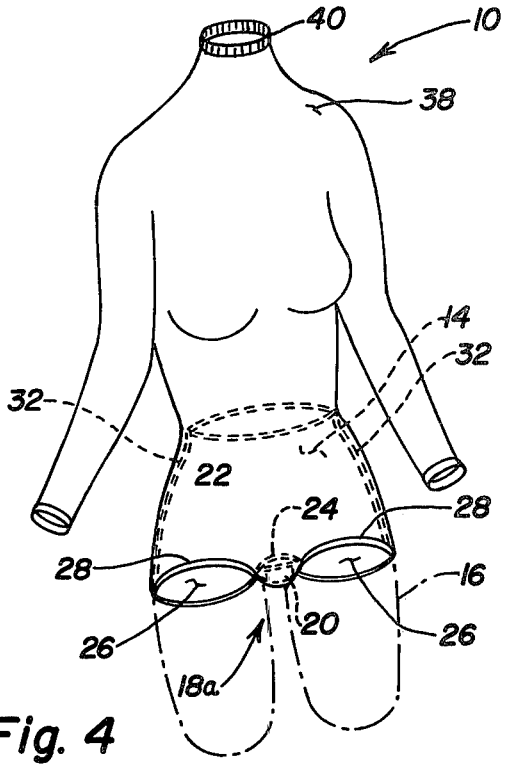
FIG. 4 is another reduced scale perspective view, similar to that as shown in FIG. 1, of an alternative exemplary style of a feminine performance costume garment and conventional panty brief undergarment combination embodying the principles of the present invention.

In FIG. 4 yet another exterior feminine performance costume garment 38 stylistic version of the instant invention 10 is shown, embodying a turtle-neck 40 rendition thereof, which in the present instance is characteristic of that type costume worn by circus performers in either equestrian or tightrope performance acts, wherein all other structural and wearer advantage features of the respective garment 38 and 14 combination as heretofore described in detail for the respective garment 12 and 14 combination remain the same, and only change being in that of the exterior costume portion stylistic modification thereof.

Figure 5:
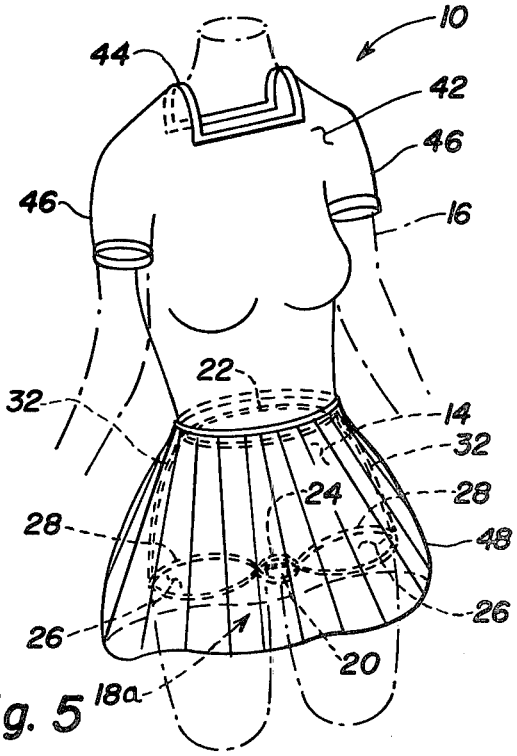
FIG. 5 is yet another reduced scale perspective view, similar to that as shown in FIG. 1, of yet another alternative exemplary style of a feminine performance costume garment and conventional panty brief undergarment combination embodying the principles of the present invention.

In FIG. 5 still another exterior feminine performance costume garment 42 stylistic version of the instant invention 10 is shown, embodying a square-neck 44 and short sleeve 46 with a pleated skirt 48 assembled thereto as shown, being illustrative of that exterior stylistic costume version of the instant invention 10 which would be characteristically worn by feminine participants and/or performers in tennis playing activities or events. As before, all other structural and wearer advantage features of the respective garment 42 and 14 combination as heretofore described in detail for the respective garment 12 and 14 combination remain the same, the only change being in that of the exterior costume portion stylistic modification thereof.

Figure 6:
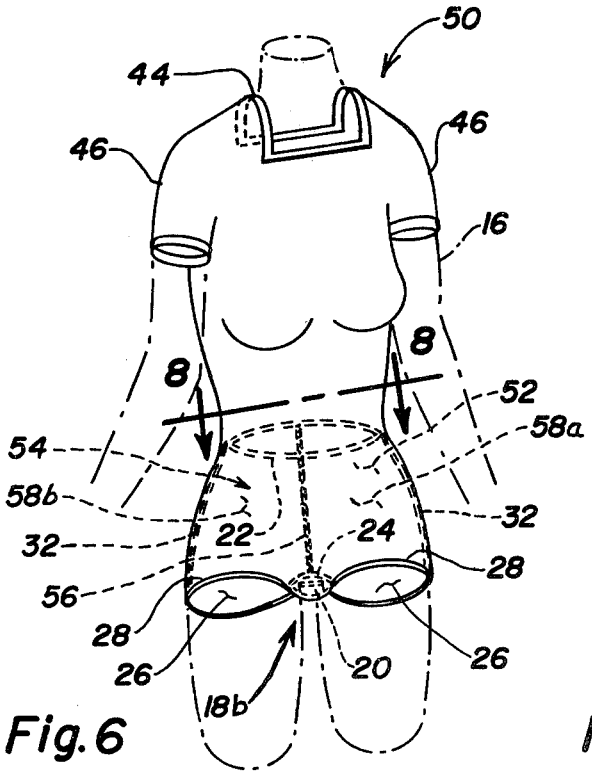
FIG. 6 is yet another reduced scale perspective view, similar to that as shown in FIG. 1, of another alternative exemplary style of a feminine performance costume garment, but, however, illustrating therein a multiple-piece form-fitting panty brief undergarment in combination therewith as embodies the principles taught by the present invention.

Considering now FIG. 6, in which modified feminine performance costume garment 50 is shown, being distinguished from the feminine performance costume garment 10 in that the modified version 50 thereof embodies the incorporation of a multi-piece panty brief undergarment 52 which enables the conformation thereof to be form-fitting to the buttocks of the feminine attiree, which in certain performance costuming applications, such as in either ballet or modern dance, is the preferred style. It will be noted that the multi-piece panty brief undergarment 52 is similar in all other respects to the modified conventional panty brief undergarment 14 excepting for the rear-panel portion 54 thereof which is shape-cut and then re-joined by shape-seam stitching 56 so as to conform the respective buttock panels 58*a* and 58*b* thus formed to be form-fitting to the buttock cheeks of the feminine attiree wearer thereof. Otherwise, all other structural and combined exterior and under garment features heretofore described remain the same, with the understanding that the exterior stylistic garment portion, as before, may be changed to suit that rendition particular to and characteristic of the specific activity for which the modified feminine performance costume garment 50 is to be used.

Figure 7:
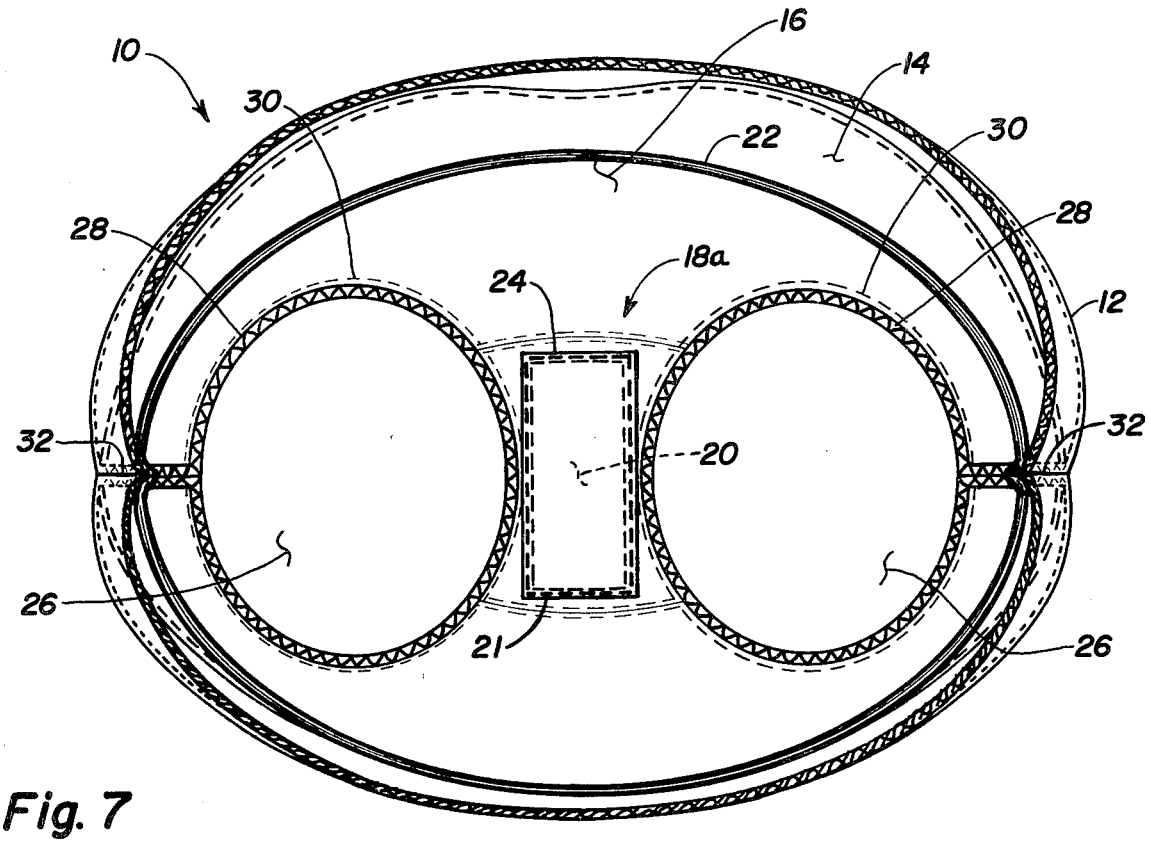
FIG. 7 is an enlarged to sectional view of a feminine performance costume garment with a conventional panty brief undergarment in combination therewith as taught by the instant invention, as shown in FIG. 1 and seen along the line 7—7 thereof.
Figure 8:
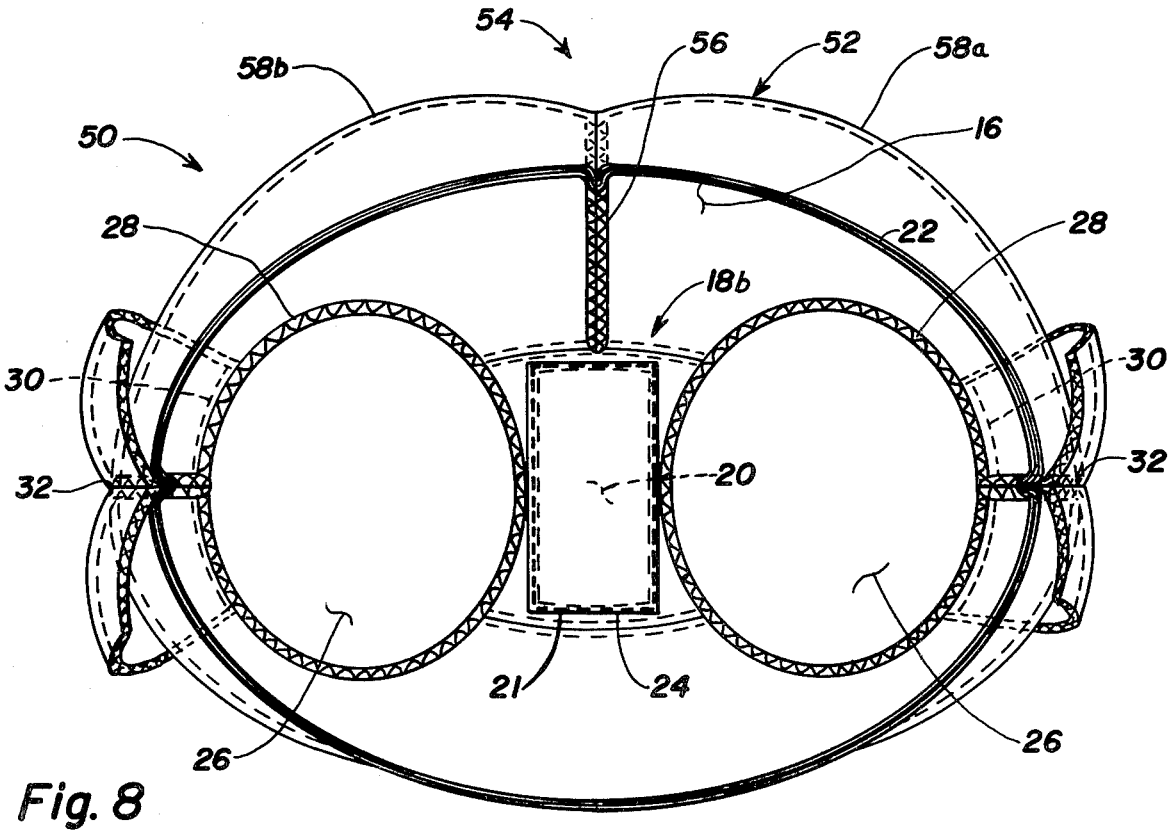
FIG. 8 is an enlarged top sectional view of another exemplary style of a feminine performance costume garment with a multi-piece form-fitting panty brief undergarment in combination therewith as alternately taught by the instant invention, as shown in FIG. 6 and seen along the line 8—8 thereof.

Considering lastly FIGS. 7 and 8, wherein a comparative illustration set shows more particularly the differences in construction between the modified conventional panty brief undergarment 14 as seen along the line 7—7 of FIG. 1 as shown in FIG. 7, and the multi-piece panty brief undergarment 52 as seen along the line 8—8 of FIG. 6 as shown in FIG. 8, in addition to the respective construction differences in the modified conventional panty brief undergarment crotch area material portion 18*a* and the multi-piece panty brief undergarment crotch area material portion 18*b*.

Although the invention has been herein shown and described in what are conceived to be the most practical and preferred embodiments, it is recognized that departures may be made therefrom within the scope of the invention, which is not to be limited to the details disclosed herein but is to be accorded the full scope of the claims so as to embrace any and all equivalent costumes and apparel suitable for or adaptable to feminine performance costume garment use in either athletic or cultural event presentations.

I claim:

1. A feminine performance costume garment for feminine attiree use in various athletic or cultural performance events and presentations structurally adapted to prevent undergarment exposure in the crotch area of the feminine wearer thereof during attired use therein, said performance costume garment comprising in combination an exterior stylistic costume garment having a neck opening, a set of arm openings, and a set of leg openings of equal length respectively interposed vertically at a relative body position between the crotch and knees of a feminine attiree therein; a unitarily constructed panty brief undergarment having a waist band and a set of leg openings of a length corresponding to that of said exterior stylistic costume garment said undergarment being inserted and oriented to attiree body position within said exterior garment wherein also each of the leg openings of each set respectively in each of said exterior and under garments are conformed peripherally for finishing; a combined finished leg opening hem respectively for each conformed peripheral exterior and under garment leg opening combination said hem respectively formed by a peripheral enclosable tucking respectively of each undergarment leg opening respectively with an excess of leg opening material of said exterior garment followed by stitching thereabout interior of the terminal peripheral combined leg opening edges thereof thus formed to thereby integrally communicate the respective exterior and under garment leg opening structures respectively one to the other; a set of exterior and under garment communicating stitchings inwardly disposed outwardly lateral of said performance costume garment and vertically disposed in parallel relationship one to the other interposed respectively between said combined finished leg opening hems and said undergarment waist band such that upon attired use by one wearing said feminine performance costume garment the respective exterior and under garment leg openings thereof move together unitarily thereby preventing undergarment exposure in the crotch area of the feminine attiree during performance and presentation use therein.

2. The feminine performance costume garment according to claim 1 in which said panty brief undergarment is provided with a pliable crotch area insert structural support and shaping means in the crotch area thereof.

3. The feminine performance costume garment according to claim 2 in which said pliable crotch area insert structural support and shaping means is in the geometric form of a first rectangular shape having respectively a first longitudinal and lateral dimension.

4. The feminine performance costume garment according to claim 2 in which said pliable crotch area insert structural support and shaping means is retained in the crotch area of said panty brief undergarment by means of an overlying crotch area insert overply.

5. The feminine performance costume garment according to claim 4 in which said overlying crotch area insert overply is in the geometric form of a second rectangular shape having a respectively slightly greater longitudinal and lateral dimension than said first rectangular shape respective first longitudinal and lateral dimensions.

6. The feminine performance costume garment according to claim 4 in which said overlying crotch area insert overply is affixed to the crotch area of said panty brief undergarment by means of a direct continuous stitching thereto peripherally about the greater respective interior longitudinal and lateral dimension edges thereof and exterior of the crotch area insert first longitudinal and lateral dimensions.

7. The feminine performance costume garment according to claim 1 having an exterior garment portion thereof styled as a gymnastic performance costume.

8. The feminine performance costume garment according to claim 1 having an exterior garment portion thereof styled as a skating performance costume.

9. The feminine performance costume garment according to claim 8 in which said skating performance costume is an ice skating costume.

10. The feminine performance costume garment according to claim 8 in which said skating performance costume is a roller skating costume.

11. The feminine performance costume garment according to claim 1 having an exterior garment portion thereof styled as a circus performance costume.

12. The feminine performance costume garment according to claim 11 in which said circus performance costume is a tightrope act costume.

13. The feminine performance costume garment according to claim 11 in which said circus performance costume is an equestrian act costume.

14. The feminine performance costume garment according to claim 1 having an exterior garment portion thereof styled as a tennis playing costume.

15. A modified feminine performance costume garment for feminine attiree use in cultural performance events and presentations structurally adapted to prevent undergarment exposure in the crotch area of the feminine wearer thereof during attired use therein, said modified performance costume garment comprising in combination an exterior stylistic costume garment having a neck opening, a set of arm openings, and a set of leg openings of equal length respectively interposed vertically at a relative body position between the crotch and knees of a feminine attiree therein; a multi-piece constructed panty brief undergarment having a waist band and a set of leg openings of a length corresponding to that of said exterior stylistic costume garment said undergarment being inserted and oriented to attiree body position within said exterior garment wherein also each of the leg openings of each set respectively in each of said exterior and under garments are conformed peripherally for finishing; a combined finished leg opening hem respectively for each conformed peripheral exterior and under garment leg opening combination said hem respectively formed by a peripheral enclosable tucking respectively of each undergarment leg opening respectively with an excess of leg opening material of said exterior garment followed by stitching thereabout interior of the terminal peripheral combined leg opening edges thereof thus formed to thereby integrally communicate the respective exterior and under garment leg opening structures respectively one to the other; a set of exterior and under garment communicating stitchings inwardly disposed outwardly lateral of said performance costume garment and vertically disposed in parallel relationship one to the other interposed respectively between said combined finished leg opening hems and said undergarment waist band such that upon attired use by one wearing said feminine performance costume garment the respective exterior and under garment leg openings thereof move together unitarily thereby preventing undergarment exposure in the crotch area of the feminine attiree during performance and presentation use therein.

16. The modified feminine performance costume garment according to claim 15 in which said multi-piece panty brief undergarment is provided with a rear-panel portion comprised of a pair of buttock panel members respectively shaped to conform to the buttock shape of the wearer thereof.

17. The modified feminine performance costume garment according to claim 15 in which said multi-piece panty brief undergarment is provided with a pliable crotch area insert structural support and shaping means in the crotch area thereof.

18. The modified feminine performance costume garment according to claim 17 in which said pliable crotch area insert structural support and shaping means is in the geometric form of a first rectangular shape having respectively a first longitudinal and lateral dimension.

19. The modified feminine performance costume garment according to claim 17 in which said pliable crotch area insert structural support and shaping means is retained in the crotch area of said multi-piece panty brief undergarment by means of an overlying crotch area insert overply.

20. The modified feminine performance costume garment according to claim 19 in which said overlying crotch area insert overply is in the geometric form of a second rectangular shape having a respectively slightly greater longitudinal and lateral dimension than said first rectangular shape respective first longitudinal and lateral dimensions.

21. The modified feminine performance costume garment according to claim 19 in which said overlying crotch area insert overply is affixed to the crotch area of said multi-piece panty brief undergarment by means of a direct continuous stitching thereto peripherally about the greater respective interior longitudinal and lateral dimension edges thereof and exterior of the crotch area insert first longitudinal and lateral dimensions.

22. The modified feminine performance costume garment according to claim 15 having an exterior garment portion thereof styled as a dance performance costume.

23. The modified feminine performance costume garment according to claim 22 in which said dance performance costume is a ballet dance costume.

24. The modified feminine performance costume garment according to claim 22 in which said dance performance costume is a modern dance costume.

25. A method of making a feminine performance costume garment, said method comprising insertion of a panty brief undergarment within an exterior performance costume garment respectively positioned with the garment fronts to front and backs to back and the respective garmet crotch areas in communication contact one with the other, hem stitching the respective garment leg openings one to the other whereby the corresponding panty brief undergarment and exterior performance costume garment leg openings are integrally unitized, and further integrally communicating the respective garments one to the other by vertically disposed stitching extending upwardly from said respective garment leg openings and outward laterally tangent thereto to an elevation corresponding to that of a waist band peripherally describing the top opening of said panty brief undergarment.

* * * * *